US010900210B2

(12) United States Patent
Peng

(10) Patent No.: US 10,900,210 B2
(45) Date of Patent: Jan. 26, 2021

(54) DRAIN PLUG LINKAGE STRUCTURE

(71) Applicant: XIAMEN LOTA INTERNATIONAL CO., LTD., Fujian (CN)

(72) Inventor: Kesheng Peng, Fujian (CN)

(73) Assignee: XIAMEN LOTA INTERNATIONAL CO., LTD., Xiamen (CN)

( * ) Notice: Subject to any disclaimer, the term of this patent is extended or adjusted under 35 U.S.C. 154(b) by 0 days.

(21) Appl. No.: 16/406,588

(22) Filed: May 8, 2019

(65) Prior Publication Data

US 2019/0345703 A1 Nov. 14, 2019

(30) Foreign Application Priority Data

May 9, 2018 (CN) ..... 2018 2 0689523 U

(51) Int. Cl.
*E03C 1/23* (2006.01)
*A47K 1/14* (2006.01)

(52) U.S. Cl.
CPC ..... *E03C 1/2302* (2013.01); *A47K 1/14* (2013.01); *E03C 1/2306* (2013.01)

(58) Field of Classification Search
CPC ..... E03C 1/2302; E03C 1/2306; E03C 1/23; E03C 2001/2311; E03C 2001/2313; E03C 2001/2315; E03C 2001/2317; A47K 1/14
See application file for complete search history.

(56) References Cited

U.S. PATENT DOCUMENTS 4,192,026 A * 3/1980 Williams ..... E03C 1/23 4/673
9,708,803 B1 * 7/2017 Lin ..... E03C 1/2302
2014/0310864 A1 * 10/2014 Ye ..... E03C 1/2302 4/295
2016/0356028 A1 * 12/2016 Ball ..... E03C 1/262

FOREIGN PATENT DOCUMENTS

CN 201224908 Y 4/2009
CN 103967082 A 8/2014

* cited by examiner

*Primary Examiner* — Janie M Loeppke
(74) *Attorney, Agent, or Firm* — Cooper Legal Group, LLC

(57) ABSTRACT

A drain plug linkage structure, comprising a pull rod assembly, a driving rod and a drain plug movably fitted in a drain pipe, the driving rod having a front end and a rear end, the front end of the driving rod being inserted from the side of the drain pipe to the drain pipe and connecting with the drain plug, the pull rod assembly comprises a connecting rod and a pull rod connected to each other, wherein one of the driving rod and the connecting rod is provided with a plurality of fixing holes, the other of the driving rod and the connecting rod is provided with a plurality of protruding fixing members, and the fixing members are detachably coupled to the fixing holes. The present invention is provided that the assembly and disassembly of the driving rod and the connecting rod of the present invention are quicker.

6 Claims, 6 Drawing Sheets

DRAIN PLUG LINKAGE STRUCTURE

TECHNICAL FIELD

The present invention relates to the field of water devices, in particular to a drain plug linkage structure.

RELATED ART

In containers such as bathrooms, tubs, washbasins or sinks, it is desirable to provide a draining device, also known as a drain, to achieve water storage or drainage in the container. Such a draining device is typically presented as a linkage device for the drain plug. For example, in a conventional draining device, the container is connected to the drain pipe through an outflow port, and a drain plug is provided near the outflow port, the drain plug is connected to one end of the operating rod, such as a lever member, and the other end of the lever member is connected to a downwardly extending pull rod member, so that the pull rod member can be operated to move the drain plug between the positions of closing and opening the outflow port, and water storage or drainage in the container such as the bathroom sink, the tub, the washbasin or the sink can be realized.

The prior art discloses a variety of such draining devices, namely drain plug linkage device.

A drain plug linkage device disclosed in the Chinese patent database with publishing number CN201410161720.6 comprises a drain plug, a pull rod assembly, an engagement mechanism and a lever member having a first end and a second end; the pull rod assembly comprises a pull rod and a connecting rod operatively coupled to each other; the first end of the lever member operatively coupled to the connecting rod, the second end of the lever member is configured to operate the drain plug; one of the connecting rod and the lever member has a plurality of through holes and is slidably mounted to an engagement mechanism, the other of the connecting rod and the lever member is configured to pass through one of the through holes and has a plurality of circumferentially spaced circumferential ribs along the axial direction and grooves defined between the circumferential ribs, the engagement mechanism is configured to block the other of the connecting rod and the lever member to move axially relative to the through hole when sliding into a position to engage the groove. There is a problem in the drain plug linkage device described in the Chinese patent CN201410161720.6, that is, when the fixed position of the driving rod and the connecting rod is close to the middle of the driving rod or close to the middle upper portion of the connecting rod, when disassembling the connecting rod and the lever member, the through hole on the connecting rod or the lever member must move a certain distance along the lever member or the connecting rod provided with the groove, so that the connecting rod and the lever member can be separated from each other.

The Chinese patent CN200820094967.0 also discloses a drain plug linkage device, which comprises a pull rod, a connecting rod, a driving rod (for example a lever member) and a drain plug, the pull rod has a bottom portion, and the bottom portion forms an engaging portion; the connecting rod has a top end, and the engaging portion of the top end corresponding to the pull rod is provided with a lock slot for engaging and fixing the engaging portion, and the end of the connecting rod apart from the lock slot is spaced disposed with a plurality of holes, the driving rod has a first end and a second end, and a section adjacent to the first end forms a plurality of fitting portions that cooperate with the holes of the connecting rod, and each of the fitting portions can be positioned with each hole through in sleeve way; the drain plug has a bottom portion that is coupled to the second end of the driving rod. There is also a problem in the drain plug linkage device described in the Chinese patent CN200820094967.0, that is, the fixed position of the driving rod and the connecting rod is close to the middle of the driving rod or close to the middle upper part of the connecting rod, when assembling the driving rod and the connection rod, the holes in the connecting rod must pass through the plurality of fitting portions to reach the required fixed position, which is very time consuming and laborious; when disassembling the driving rod and the connecting rod, the holes in the connecting rod must pass through the plurality of fitting portions to separate the connecting rod and the driving rod from each other, which is also very time consuming and laborious.

SUMMARY OF THE INVENTION

The object of the present invention is to provide a drainage plug linkage structure, which can realize quick assembly and disassembly between the driving rod and the connecting rod.

In order to achieve the above object, the technical solution of the present invention is that:

A drain plug linkage structure, comprising a pull rod assembly, a driving rod and a drain plug movably fitted in a drain pipe, the driving rod having a front end and a rear end, the front end of the driving rod being inserted from the side of the drain pipe to the drain pipe and connecting with the drain plug, the pull rod assembly comprises a connecting rod and a pull rod connected to each other, wherein one of the driving rod and the connecting rod is provided with a plurality of fixing holes, the other of the driving rod and the connecting rod is provided with a plurality of protruding fixing members, and the fixing members are detachably coupled to the fixing holes.

In another preferred embodiment, each of the fixing members comprises at least two elastic hooks that are movably engaged with the fixing holes.

In another preferred embodiment, the driving rod is provided with the fixing holes, and the connecting rod is provided with the fixing members, and a lock sleeve is slidably sleeved on the driving rod; the fixing hole is a circular hole, and the fixing member is a cylinder having two annular lock slots on the side wall, the diameter of the fixing member is smaller than the aperture of the fixing hole; one end of the lock sleeve is provided with two claws for respectively engaging the two annular lock slots of the fixing member.

In another preferred embodiment, the other end of the lock sleeve is provided with a push-pull piece.

In another preferred embodiment, the connecting rod is provided with a cavity with an opening facing upward, and a threaded hole is formed in a sidewall of the cavity, the bottom of the pull rod is inserted into the cavity, and the screw hole is fitted with a wing screw.

In another preferred embodiment, further comprising a connecting base, a connecting cover and a spherical body; the spherical body is fixed on the driving rod and located between the front end and the rear end of the driving rod; the connecting base is formed with a through hole through which the front end of the driving rod passes, and the connecting cover is formed with an insertion hole through which the rear end of the driving rod passes, the connecting base and the connecting cover are threaded to form a limiting cavity, the spherical body is rotatably received in the limiting cavity; a sidewall of the drain pipe is formed with a cylindrical mounting opening, and the front end of the driving rod is inserted into the drain pipe, and the connecting base is buckled to the mounting opening.

In another preferred embodiment, a front portion of the connecting base extends into the mounting opening, and a rear portion of the connecting base is provided with two connecting claws, a side wall of the mounting opening is provided with two lock holders which are outwardly convex and are respectively engaged with the two connecting claws, and a gap is formed between the two lock holders for the connecting claws to pass through.

In another preferred embodiment, a front portion of the connecting base extends into the mounting opening, and a rear portion of the connecting base is provided with at least two outward convex lock edges, a guide hole is formed between the lock edge and the side wall of the connecting base, and the side wall of the mounting hole is provided with a fixing claw passing through the guide hole and being engaged with the lock edge.

With the above solution, one of the driving rod and the connecting rod of the present invention is provided with a plurality of fixing holes, and the other of the driving rod and the connecting rod is provided with a plurality of protruding fixing members. The fixing members are detachably connected to the fixing holes, so that when the driving rod of the present invention is assembled with the connecting rod, the fixing member and the fixing hole can be directly connected so as to connect the connecting rod with the driving rod, and when the driving rod and the connecting rod of the present invention are disassembled, the connecting holes and the fixing members are separated from each other to disassemble the connecting rod from the driving rod; compared with the prior art, the assembly and disassembly of the driving rod and the connecting rod of the present invention are quicker and easier.

SYMBOL DESCRIPTION

Figure 1:
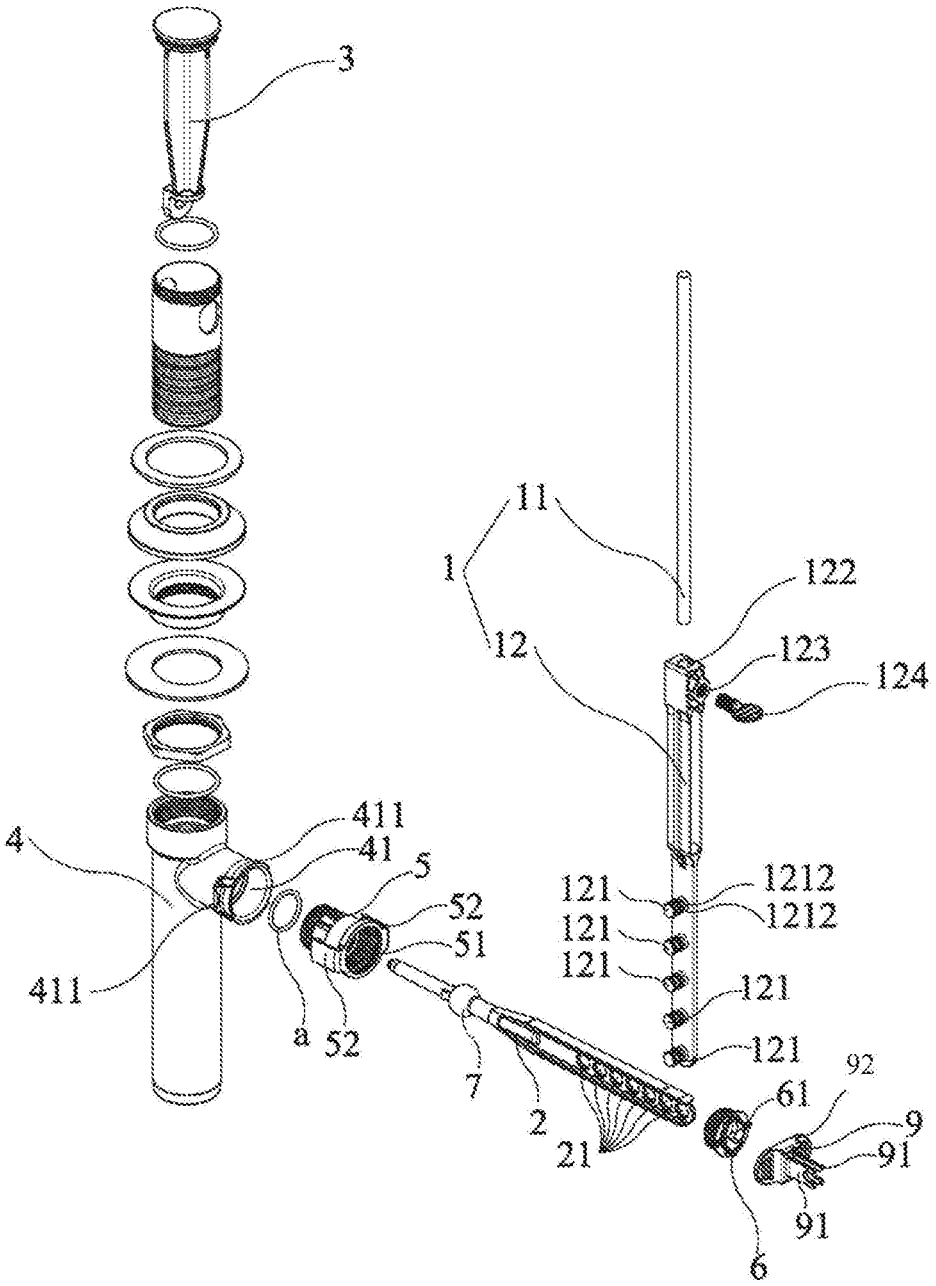
FIG. 1 is an exploded view of Embodiment 1 of the present invention.

Pull rod assembly 1, pull rod 11, connecting rod 12, fixing member 121, elastic hook 1211, annular lock slot 1212, cavity 122, screw hole 123, wing screw 124, driving rod 2, fixing hole 21, drain plug 3, drain pipe 4, mounting opening 41, lock holder 411, fixing claw 412, connecting base 5, through hole 51, connecting claw 52, lock edge 53, guide hole 54, connecting cover 6, through hole 61, spherical body 7, limiting cavity 8, lock sleeve 9, the claw 91, the push-pull piece 92, and the sealing ring a.

DETAILED DESCRIPTION OF THE EMBODIMENTS

In order to further explain the technical solutions of the present invention, the present invention will be described in detail below through specific embodiments.

Embodiment 1

Figure 2:
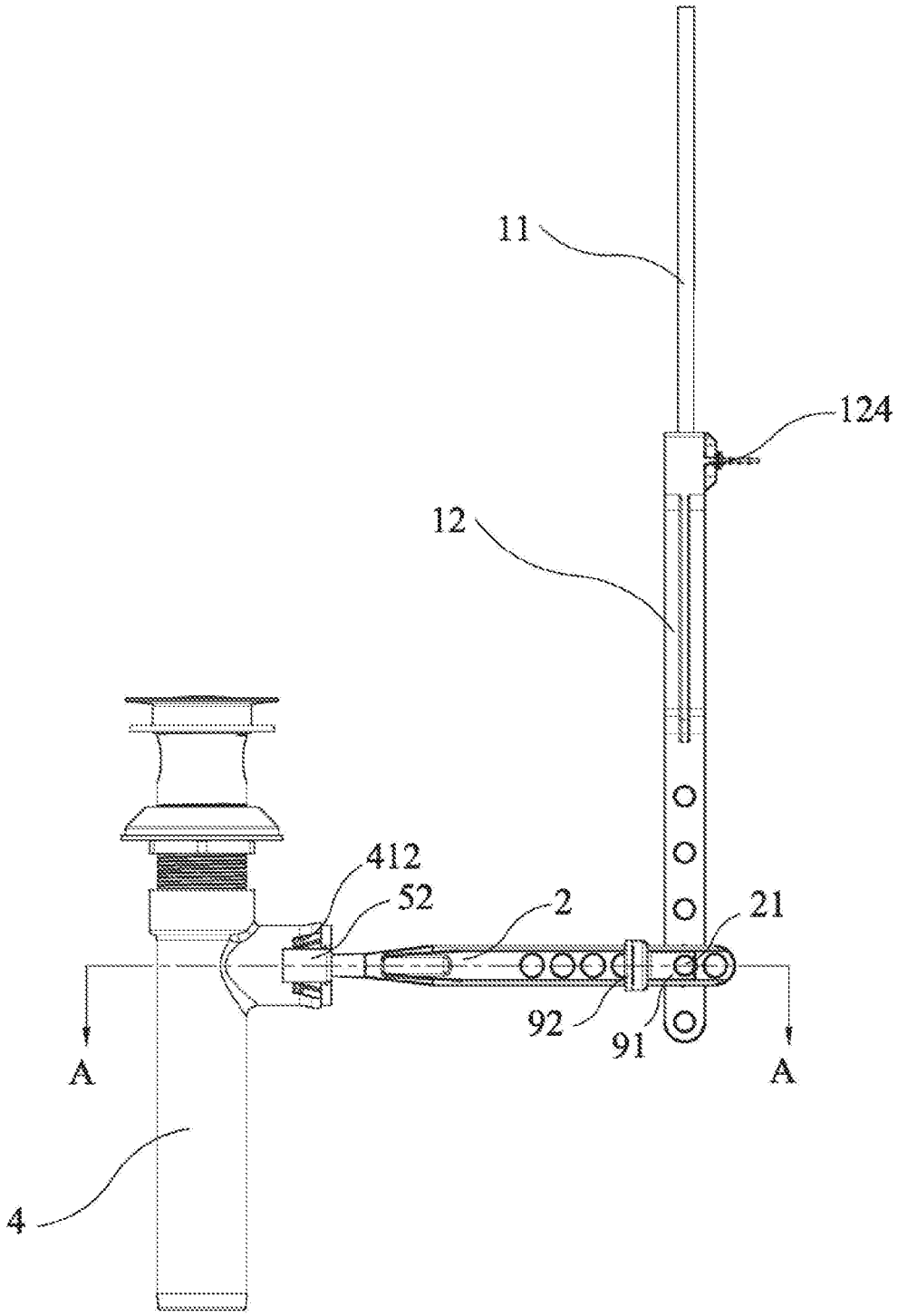
FIG. 2 is a schematic view of the combination of Embodiment 1 of the present invention.
Figure 3:
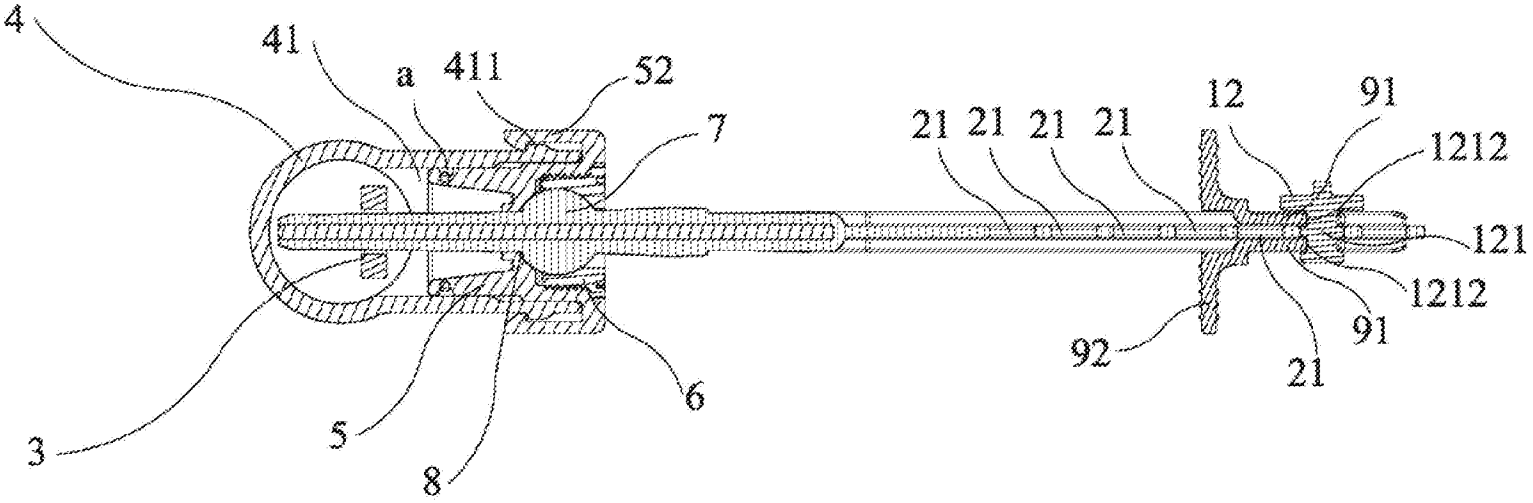
FIG. 3 is a cross-sectional view taken along line A-A of FIG. 2.

As shown in FIGS. 1 to 3, the present embodiment discloses a drain plug linkage structure comprising a pull rod assembly 1, a driving rod 2, and a drain plug 3 movably fitted in the drain pipe 4, wherein the drain plug 3 movably matched with the drain pipe 4 is disclosed in the prior art, and therefore will not be described herein.

As shown in FIG. 1 to FIG. 3, in this embodiment, the driving rod 2 has a front end and a rear end, and the driving rod 2 is provided with a plurality of fixing holes 21, and the front end of the driving rod 2 extends into the drain pipe 4 and is connected to the drain plug 3; the pull rod assembly 1 comprises a connecting rod 12 and a pull rod 11 which are connected to each other, the rear end of the driving rod 2 is linked to the pull rod 11 by the connecting rod 12. The connecting rod 12 is provided with a plurality of protruding fixing members 121. The fixing member 121 is detachably connected to any of the fixing holes 21. The opening direction of the fixing hole 21 is parallel to the protruding direction of the fixing member 121. Since that, when the fixing hole 21 and the fixing member 121 are connected or detached, the driving rod 2 or the connecting rod 12 only needs to move relative to the fixing member 121 along the protruding direction of the fixing member 121, which is not like the prior art, the connecting rod or the driving rod can be detached after being moved a certain distance along its length, and the assembly and disassembly processes are relatively labor-saving and convenient.

In this embodiment, the fixing hole 21 is a circular hole, and the fixing member 121 is a cylinder having two annular lock slots 1212 on the side wall, and the diameter of the fixing member 121 is smaller than the diameter of the fixing hole 21; a lock sleeve 9 is slidably sleeved on the driving rod 2; one end of the lock sleeve 9 is provided with two claws 91 for respectively engaging two annular lock slots 1212 of the fixing member 121. When the driving rod 2 is assembled with the connecting rod 12, the fixing member 121 to be connected is passed through the fixing hole 21 to be connected, the two annular lock slots 1212 are disposed at the two sides of the fixing hole, and then the lock sleeve 9 is moved so that the two claws 91 of the lock sleeve 9 are caught by the fixing member to be connected. The two annular lock slots 1212 of the 121 can connect the connecting rod 12 with the driving rod 2; when the driving rod 2 is disassembled from the connecting rod, the lock sleeve 9 is reversely moved so that the two claws 91 of the lock sleeve 9 are disassembled from the two annular lock slots 1212 of the fixing member 121, and then the mating fixing members 121 and the fixing holes 21 are disassembled, so that the connecting rod 12 is completely disassembled from the driving rod 2. In order to facilitate the movement of the lock sleeve 9, the other end of the lock sleeve 9 is provided with a push-pull piece 92.

It should be noted that the drain plug linkage structure is not limited to the plurality of fixing holes 21 provided on the driving rod 2 and the connecting rod 12 provided with a plurality of detachable connections with the fixing holes 21. The fixing member 121 may be provided with a plurality of fixing holes 21 on the connecting rod 12, and the driving rod 2 is provided with a plurality of fixing members 121 detachably connected to the fixing holes 21, and the lock sleeve 9 is slidably sleeved on the connecting rod 12.

As shown in FIG. 1 and FIG. 2, in the embodiment, the connecting rod 12 is provided with a cavity 122 with opening 122 facing upward for the insertion of the bottom portion of the pull rod 11, and a screw hole 123 is formed in the side wall of the cavity 122. The screw hole 123 is fitted with a wing screw 124, and the wing screw 124 can press against the bottom portion of the pull rod 11 by rotating the wing screw 124, so that the pull rod 11 is fixedly connected with the connecting rod 12. As shown in FIG. 1 to FIG. 3, in the embodiment, the drain plug linkage structure further comprises a connecting base 5, a connecting cover 6 and a spherical body 7; the spherical body 7 and the driving rod 2 can be integrally formed and the spherical body 7 is fixed on the driving rod 2, and the spherical body 2 can also be separately formed and fixedly connected with the driving rod 2; the spherical body 7 is located between the front end and the rear end of the driving rod 2; a through hole 51 through which the front end of the driving rod 2 passes is formed on the connecting base 5, and the connecting cover 6 is formed with an insertion hole 61 through which the rear end of the driving rod 2 passes, and the connecting base 5 and the connecting cover 6 are screwed to forming a limiting cavity 8, the spherical body 7 is rotatably received in the limiting cavity 8; a side wall of the drain pipe 4 is formed with a cylindrical structure mounting opening 41, the front end of the driving rod 2 extends from the mounting opening 41 into the drain pipe 4; the connecting base 5 and the mounting opening 41 can be connected by means of a snap connection, thereby facilitating quick assembly and disassembly between the connecting base 5 and the mounting opening 41. Specifically, in this embodiment, the front portion of the connecting base 5 extends into the mounting opening 41, and a sealing ring a may be disposed between the front portion of the connecting base 5 and the mounting opening 41 to realize a sealing engagement of the front portion of the connecting base and the mounting opening 41; the rear portion of the connecting base 5 is provided with two connecting claws 52, and the side wall of the mounting opening 41 is provided with two outwardly protruding lock holders 411 respectively locked to the connecting claws, and a gap is formed between the two lock holders 411 for the connecting claws 51 to pass through; when the driving rod 2 is mounted on the mounting opening 41, the driving rod 2, the connecting base 5, the connecting cover 6 and the spherical body 7 are firstly assembled together, and then the two connecting claws 52 of the connecting base 5 are pushed forward from the gap between the two lock holders 411 into the mounting opening 41 to make the front end of the driving rod extend into the drain pipe 4 from the mounting opening 41, and then the connecting base 5 is rotated, so that the two connecting claws 51 of the connecting base 5 can be caught by the two lock holders 411 of the mounting opening 41, and the entire process assembly is unnecessary to move the connecting claw 51, so that the operation is more labor-saving; and when the driving rod 2 is detached from the mounting opening 41, the connecting base 5 is rotated, so that the two connecting claws 51 of the connecting base 5 are aligned with the gap between the two lock holders 411, and the connecting base 5 is reversely moved to disengage the connecting base 5 from the mounting opening 41, so that the driving rod 2 can be detached from the mounting opening 41, the entire disassembly process is also unnecessary to move the connecting claws 51, making the operator more labor-saving.

Embodiment 2

Figure 4:
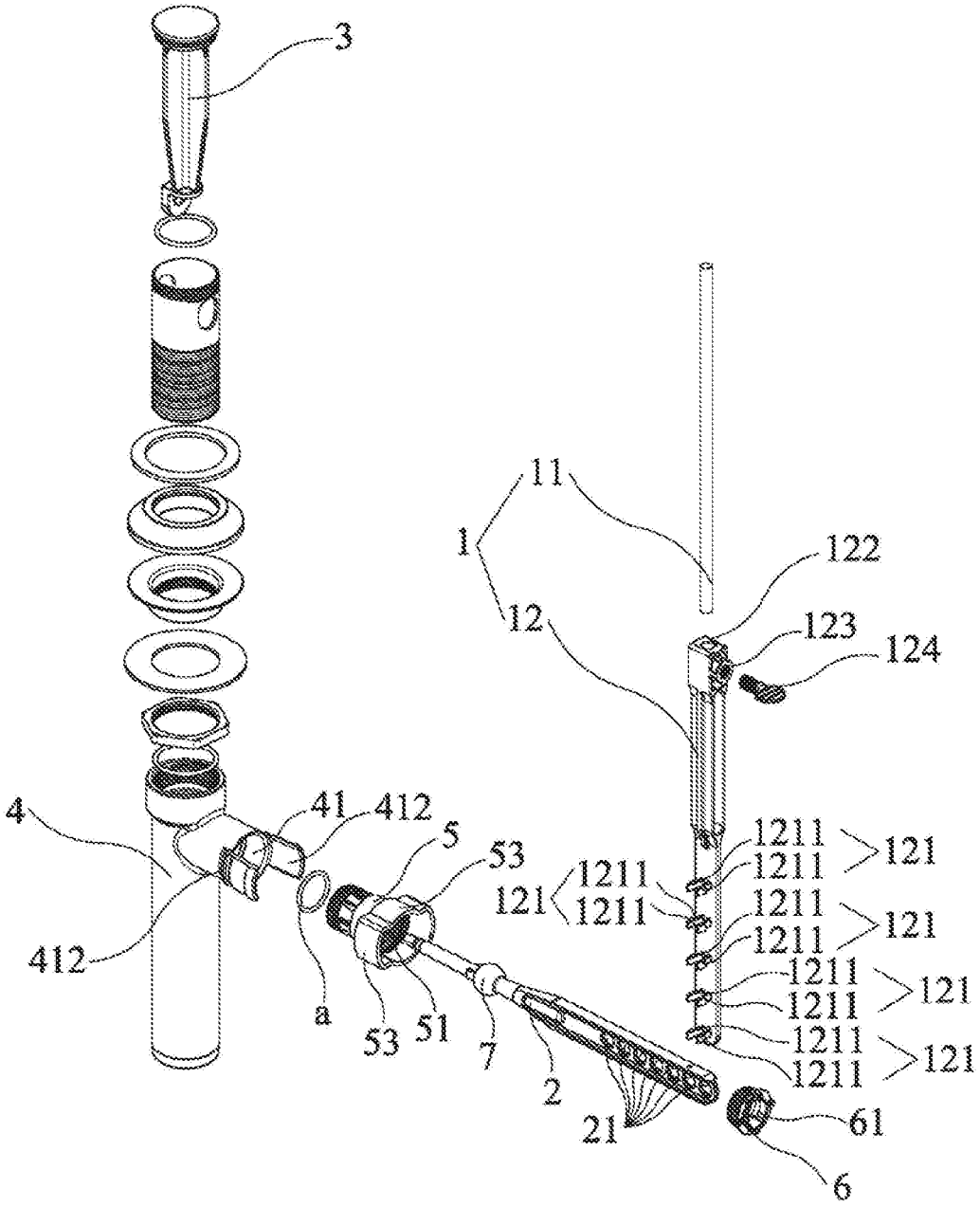
FIG. 4 is an exploded view of Embodiment 2 of the present invention.
Figure 5:
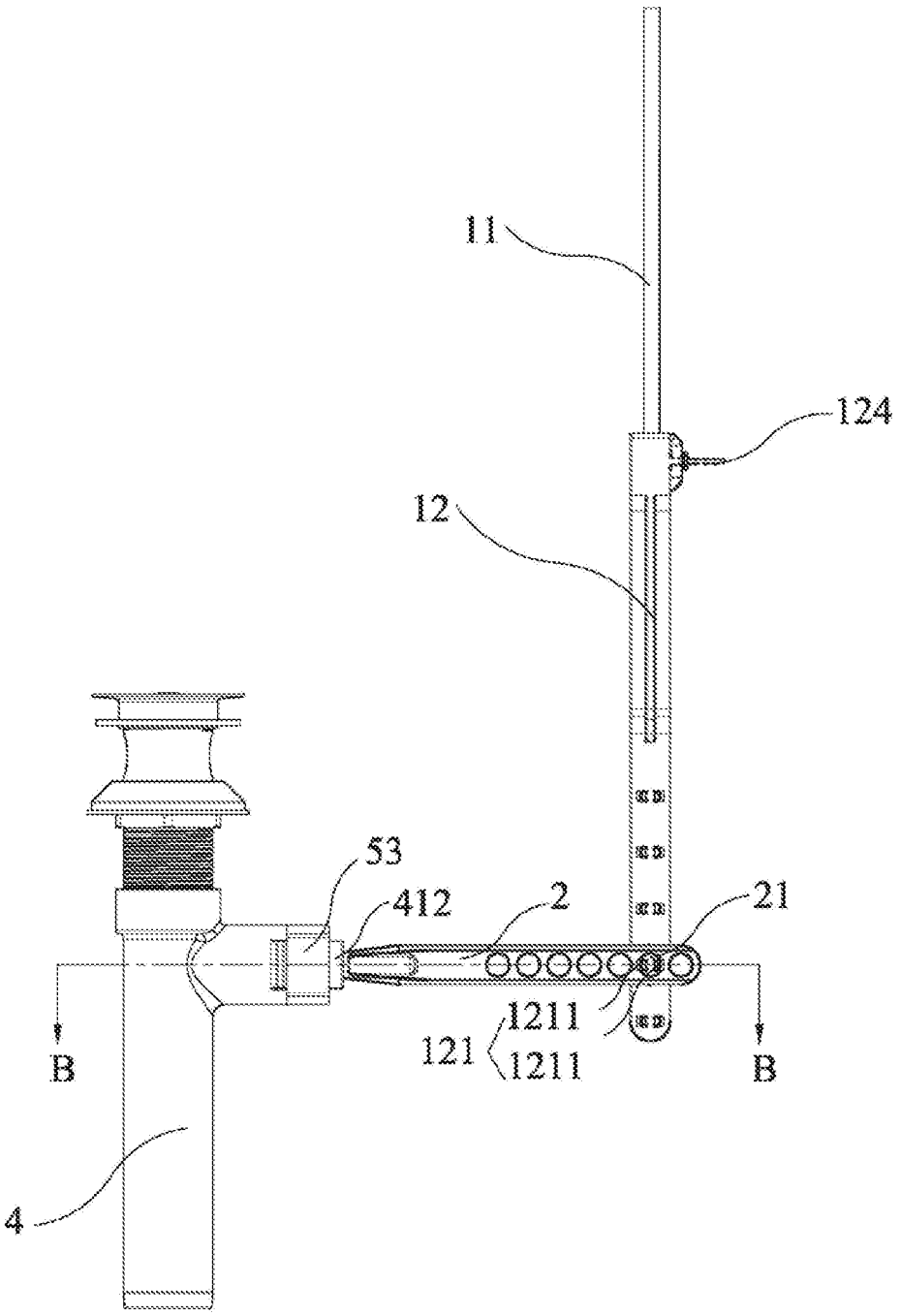
FIG. 5 is a schematic view showing the combination of Embodiment 2 of the present invention.
Figure 6:
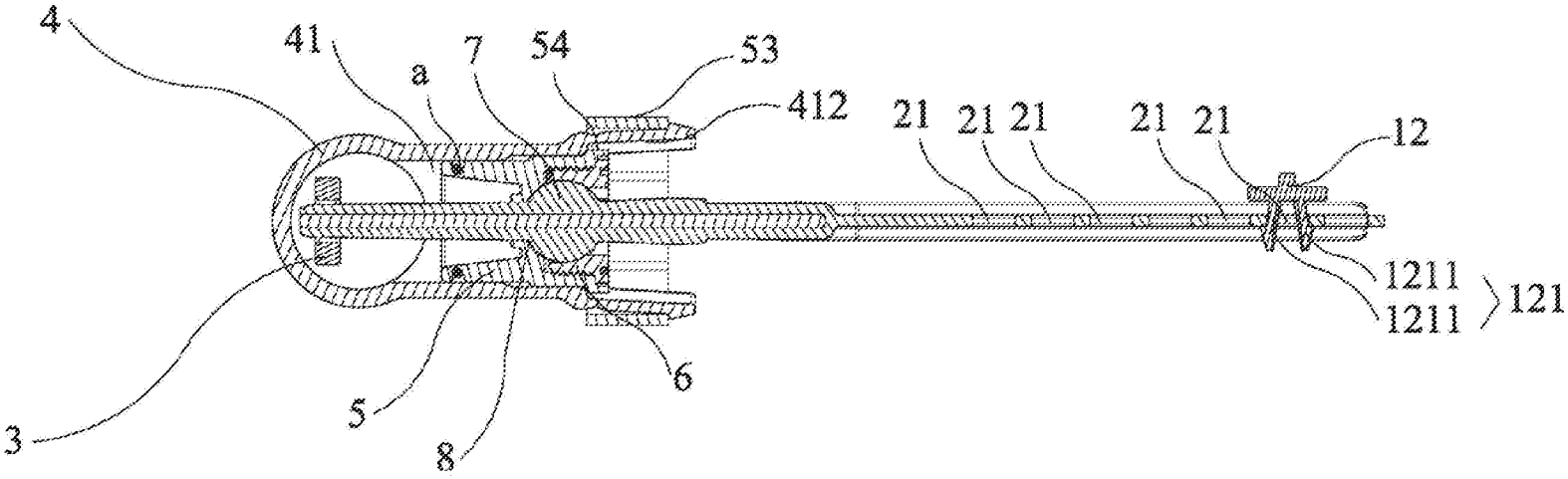
FIG. 6 is a cross-sectional view taken along line B-B of FIG. 3.

As shown in FIG. 4 to FIG. 6, this embodiment discloses a drain plug linkage structure, which comprises a pull rod assembly 1, a driving rod 2 and a drain plug 3 movably fitted in the drain pipe 4, wherein the drain plug is 3 movably matched with the drain pipe 4 in the prior art, and therefore will not be described herein.

As shown in FIG. 4 to FIG. 6, in this embodiment, the driving rod 2 has a front end and a rear end, and the driving rod 2 is provided with a plurality of fixing holes 21, the front end of the driving rod 2 is inserted from the side of the drain pipe 4 into the drain pipe 4 and is connected to the drain plug 3; the pull rod assembly 1 comprises a connecting rod 12 and a pull rod 11 which are connected to each other, and the connecting rod 12 is provided with a plurality of protruding fixing members 121. The fixing member 121 is detachably connected to any of the fixing holes 21. The opening direction of the fixing hole 21 is parallel to the protruding direction of the fixing member 121. Since that, when the fixing hole 21 and the fixing member 121 are connected or detached, the driving rod 2 or the connecting rod 12 only needs to move relative to the fixing member 121 along the protruding direction of the fixing member 121, which is not like the prior art, the connecting rod or the driving rod can be detached after being moved a certain distance along its length, and the assembly and disassembly processes are relatively labor-saving and convenient.

In this embodiment, each of the fixing members 121 comprises at least two elastic hooks 1211 that are movably engaged with the fixing holes 21. When the driving rod 2 is assembled with the connecting rod 12, the connecting rod 12 and the driving rod can be made by simply engaging the elastic hook 1211 with the fixing hole 21 to be connected by pressing the elastic hook 1211 of the fixing member 121 to be connected. When the driving rod 2 and the connecting rod are detached, the elastic hook 1211 is disassembled from the fixing hole 21 by pressing the elastic hook 1211 of the fixing member 121, so that the connecting rod 12 is completely disassembled from the driving rod 2.

It should be noted that the drain plug linkage structure is not limited to the plurality of fixing holes 21 provided on the driving rod 2 and the connecting rod 12 provided with a plurality of detachable connections with the fixing holes 21. The fixing member 121 may be provided with a plurality of fixing holes 21 on the connecting rod 12 and the driving rod 2 may be provided with a plurality of fixing members 121 detachably connected to the fixing holes 21.

As shown in FIG. 4 and FIG. 5, in this embodiment, the connecting rod 12 is provided with an opening 122 facing upward for inserting the bottom portion of the rod 11, and a screw hole 123 is formed in the side wall of the cavity 122, the screw hole 123 is fitted with a wing screw 124, and the wing screw 124 can be pressed against the bottom of the pull rod 11 by rotating the wing screw 124, so that the pull rod 11 is fixedly connected with the connecting rod 12.

As shown in FIG. 4 to FIG. 6, in this embodiment, the drain plug linkage structure further comprises a connecting base 5, a connecting cover 6 and a spherical body 7; the spherical body 7 and the driving rod 2 are integrally formed and the spherical body 7 is fixed on the driving rod 2, and the spherical body 2 can also be separately formed and fixedly connected with the driving rod 2; the spherical body 7 is located between the front end and the rear end of the driving rod 2; a through hole 51 through which the front end of the driving rod 2 passes is formed, and the connecting cover 6 is formed with an insertion hole 61 through which the rear end of the driving rod 2 passes, and the connecting base 5 and the connecting cover 6 are screwed to form a limiting cavity 8, the spherical body 7 is rotatably received in the limiting cavity 8; a sidewall of the drain pipe 4 is formed with a cylindrical mounting opening 41, the front end of the driving rod 2 extends from the mounting opening 41 into the drain pipe 4; the connecting base 5 and the mounting opening 41 can be connected by means of a snap connection, thereby facilitating quick assembly and disassembly between the connecting base 5 and the mounting opening 41. Specifically, in this embodiment, the front portion of the connecting base 5 extends into the mounting opening 41, and a sealing ring a may be disposed between the front portion of the connecting base 5 and the mounting opening 41 to realize sealingly engagement of he front portion of the connecting base with the mounting opening 41; the rear portion of the connecting base 5 is provided with at least two outwardly protruding lock edges 53, and a guide is formed between the lock edge 53 and the side wall of the connecting base 54 is provided with a fixing claw 412 passing through the guide hole 54 and engaging with the lock edge 53 on the side wall of the mounting opening 41.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A drain plug linkage structure, comprising:
a pull rod assembly,
a driving rod, and
a drain plug movably disposed in a drain pipe, wherein:
the driving rod comprises a front end and a rear end,
the front end of the driving rod is disposed in the drain pipe from a side of the drain pipe and is connected to the drain plug,
the pull rod assembly comprises a connecting rod and a pull rod connected to the connecting rod,
the driving rod is disposed with at least one fixing hole,
the connecting rod is disposed with at least one protruding fixing member,
the at least one protruding fixing member is detachably connected to the at least one fixing hole,
a lock sleeve slidably surrounds the driving rod,
a side wall of each of the at least one protruding fixing member comprises a cylinder comprising two annular lock slots,
a diameter of each of the at least one protruding fixing member is smaller than a diameter of a corresponding one of the at least one fixing hole,
when one of the at least one protruding fixing member is disposed in a corresponding one of the at least one fixing hole, the two annular lock slots of the one of the at least one protruding fixing member are disposed at two sides of the corresponding one of the at least one fixing hole, and
a first end of the lock sleeve is disposed with two claws for respectively engaging with the two annular lock slots of the one of the at least one protruding fixing member.

2. The drain plug linkage structure according to claim 1, wherein a second end of the lock sleeve is disposed with a push-pull piece.

3. The drain plug linkage structure according to claim 1, wherein: the connecting rod is disposed with a cavity with an opening facing upward, a side wall of the cavity comprises a threaded hole, a bottom of the pull rod is disposed in the cavity, and the threaded hole is engaged with a wing-shaped screw.

4. The drain plug linkage structure according to claim 1, comprising:
a connecting base,
a connecting cover, and
a spherical body, wherein:
the spherical body is fixedly disposed on the driving rod between the front end and the rear end of the driving rod,
the connecting base comprises a through hole configured to enable the front end of the driving rod to pass through,
the connecting cover comprises an insertion hole configured to enable the rear end of the driving rod to pass through,
the connecting base is screwed to the connecting cover to define a limiting cavity,
the spherical body is rotatably disposed in the limiting cavity,
a side wall of the drain pipe comprises a cylindrical mounting opening, and
the front end of the driving rod is disposed in the drain pipe through the cylindrical mounting opening, and
the connecting base is buckled to the cylindrical mounting opening.

5. The drain plug linkage structure according to claim 4, wherein:
a front portion of the connecting base extends into the cylindrical mounting opening,
a rear portion of the connecting base is disposed with two connecting claws,
a side wall of the cylindrical mounting opening extends outward to define two lock holders configured to respectively engage with the two connecting claws, and
a gap configured to enable the two connecting claws to pass through is defined between the two lock holders.

6. The drain plug linkage structure according to claim 4, wherein:
a front portion of the connecting base extends into the cylindrical mounting opening,
a rear portion of the connecting base is disposed with at least two lock edges protruding outward,
a guide hole is defined between the at least two lock edges and a side wall of the connecting base, and
a side wall of the cylindrical mounting hole is disposed with a fixing claw passing through the guide hole and being engaged with the at least two lock edges.

* * * * *